US007530341B2

(12) United States Patent
Carpenter

(10) Patent No.: US 7,530,341 B2
(45) Date of Patent: May 12, 2009

(54) INTAKE SYSTEM

(75) Inventor: Timothy Neil Carpenter, Galesburg, MI (US)

(73) Assignee: Mann+Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/857,506

(22) Filed: Sep. 19, 2007

(65) Prior Publication Data

US 2009/0071432 A1 Mar. 19, 2009

(51) Int. Cl.
*F02M 35/10* (2006.01)

(52) U.S. Cl. ..... 123/184.57; 181/229

(58) Field of Classification Search ..... 123/184.57, 123/184.53; 181/229

See application file for complete search history.

(56) References Cited

U.S. PATENT DOCUMENTS 3,157,932 A * 11/1964 Kyrias ..... 24/271
5,063,642 A * 11/1991 Toth ..... 24/274 R
5,918,572 A * 7/1999 Suzuki ..... 123/184.57

FOREIGN PATENT DOCUMENTS

EP 0559505 A1 9/1993
FR 2667922 A1 4/1992
JP 11132122 A * 5/1999

* cited by examiner

*Primary Examiner*—Noah Kamen
(74) *Attorney, Agent, or Firm*—Gudrun E. Huckett

(57) ABSTRACT

An intake system for an internal combustion engine has an intake conduit of thermoplastic material provided with an intake socket having an annular collar. At least one acoustic element is concentrically connected to the intake socket of the intake conduit, wherein the acoustic element is insertable into the annular collar. A closure surrounds the annular collar wherein the closure is a metal clamp having a metal strap and a metal clip. The metal clip effects a releasable clamping action with a variable diameter of the metal clamp.

5 Claims, 1 Drawing Sheet

INTAKE SYSTEM

BACKGROUND OF THE INVENTION

The invention relates to an intake system for internal combustion engines. The intake system comprises an intake conduit of thermoplastic material and at least one acoustic element, in particular, a quarter wave tube and/or a Helmholtz resonator, wherein the acoustic element is attached by a concentric connecting socket to the intake conduit. In the area of the connecting socket, the intake conduit has an annular collar and the acoustic element is insertable into the annular collar.

FR 2667922 and EP 559 505 disclose such connections for intake systems. These connections are usually comprised of an inner sleeve onto which a hose is pushed as well as an outer sleeve pushed onto the exterior side of the sleeve. The two sleeves are connected to one another approximately at the center. A disadvantage of such sleeves is the relatively great expenditure and lack of operational safety. In particular, there is the danger that these connections become detached as a result of vibrations and shocks that occur permanently in the case of an intake system.

It is therefore an object of the present invention to provide a connecting system for an intake conduit of an internal combustion engine that operates reliably and that can be attached and detached in a simple way.

SUMMARY OF THE INVENTION

In accordance with the present invention, this is achieved in that a closure means extends about or surrounds the annular collar and in that the closure means is a metal strap comprising a metal clip and the metal clip effects a releasable and diameter-variable clamping action.

The important advantage of the invention resides in that on the intake conduit a concentric connecting socket is provided and that the acoustic element, for example, a Helmholtz resonator, a resonance chamber or a quarterwave tube, can be attached to this socket by means of a metal strap, which metal strap is variable with regard to its diameter. So-called hose clamps are known but they have the disadvantage that a significant manual expenditure as well as appropriate tools are required for attaching them in order to realize a connection of the acoustic element on the intake system.

The advantage of the invention resides in its simple handling and its simple and operationally safe fixation of acoustic elements.

According to one embodiment of the invention, the metal strap and/or the metal clip are made from spring steel. According to a further embodiment, the metal strap is provided with locking projections so that a diameter-variable fixation is possible.

These features and additional features will become apparent from the attached claims as well as the following description and the drawings.

DESCRIPTION OF THE PREFERRED EMBODIMENTS

Figure 1:
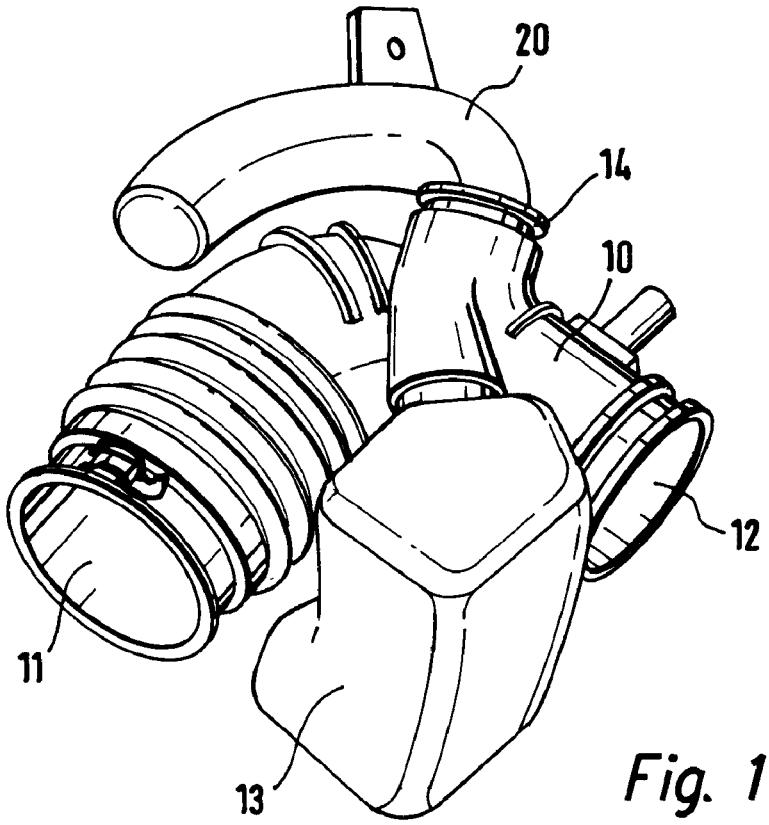
FIG. 1 shows a detail of an intake system with acoustic element.

A detail of an intake system of an internal combustion engine is illustrated in FIG. 1. Shown is an intake pipe 10 that is curved and usually is provided between the air intake pipe and air filter. It has an inlet 11 and an outlet 12 as well as in the area of the curvature a quarter wave tube 20 and arranged opposite thereto a resonance chamber 13. Usually, such acoustic elements are glued to an intake pipe or welded or fused thereto. This requires a high mounting expenditure. In the illustrated embodiment, the two acoustic elements are fastened by means of a metal clamp 15, 16, 17 18.

Figure 2:
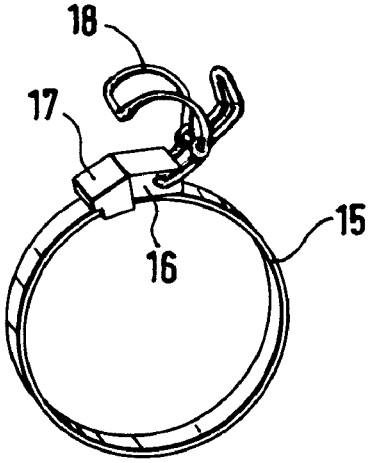
FIG. 2 is a metal strap for attaching acoustic elements on an intake system, wherein the clip on the metal strap is shown in an open position.

This is realized in that on the connecting socket of the intake conduit, in the area that is connected to the acoustic element, an annular collar 14 is provided. This annular collar 14 surrounds an opening and the acoustic element is inserted into this opening. The annular collar 14 is designed such that a metal clamp or a metal strap 15, as shown in FIG. 2, can be arranged thereon. This metal strap 15 has a clip support 16 as well as a locking projection or locking element 17. On the clip support 16 a conventional spring steel clip 18 is arranged. The clip support 16 or the locking element 17 can be moved along the metal strap 15 in order to adjust the diameter of the metal clamp, preferably so that the diameter is increased and/or decreased from an initial position (0%) up to 30%, respectively. There is also the possibility of arranging both parts 16, 17 fixedly on the metal strap 15 so as to provide a fixed diameter of the metal clamp and to attach the acoustic elements by means of different metal straps of different diameters on the annular collar, as needed.

Figure 3:
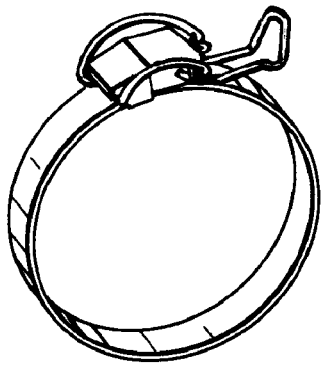
FIG. 3 shows the clip on the metal strap according to FIG. 2 in a closed position.

While FIG. 2 shows a metal strap with an open spring steel clip 18, FIG. 3 shows the spring steel clip 18 in the closed position locked on the locking element 17. Such spring steel clips 18 can be provided on the inlet 11 and/or on the outlet 12 for the purpose of connecting additional functional elements thereto or, for example, for attaching the intake system to an air filter or on the air intake system. Of course, it is also possible to arrange the entire system between air filter and intake pipe of an internal combustion engine.

While specific embodiments of the invention have been shown and described in detail to illustrate the inventive principles, it will be understood that the invention may be embodied otherwise without departing from such principles.

What is claimed is:

1. An intake system for an internal combustion engine, the intake system comprising:

an intake conduit of thermoplastic material provided with an intake socket having an annular collar;

at least one acoustic element concentrically connected to the intake socket of the intake conduit, wherein the acoustic element is insertable into the annular collar;

a closure means surrounding the annular collar, wherein the closure means is a metal clamp comprising a metal strap, a clip support arranged on the metal strap so as to be movable relative to the metal strap in order to provide a variable diameter of the metal clamp, and a spring steel clip that is pivotably supported on the clip support, wherein the metal clamp has no tensioning screw for tightening the metal clamp and wherein the spring steel clip effects a releasable clamping action when the spring steel clip is pivoted from a release position into a clamping position in which the spring steel clip engages a locking element and tightens the metal damp.

2. The intake system according to claim 1, wherein the metal clamp is variable in size by increasing a diameter of the metal clamp up to 30% from an initial position.

3. The intake system according to claim 1, wherein the metal clamp is variable in size by decreasing a diameter of the metal clamp up to 30% from an initial position.

4. The intake system according to claim 1, wherein the metal clamp is variable in size by varying a diameter of the metal clamp up to 30% from an initial position so as to increase and decrease the diameter.

5. The intake system according to claim 1, wherein the at least one acoustic element is selected from the group consisting of a quarter wave tube and a Helmholtz resonator.

* * * * *